US007890003B2

(12) United States Patent
Ito

(10) Patent No.: US 7,890,003 B2
(45) Date of Patent: Feb. 15, 2011

(54) IMAGE FORMING APPARATUS

(75) Inventor: Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 417 days.

(21) Appl. No.: 12/071,640

(22) Filed: Feb. 25, 2008

(65) Prior Publication Data

US 2008/0205917 A1 Aug. 28, 2008

(30) Foreign Application Priority Data

Feb. 28, 2007 (JP) ..... 2007-049295

(51) Int. Cl.
*G03G 15/00* (2006.01)
*G03G 21/20* (2006.01)
*G03G 15/08* (2006.01)

(52) U.S. Cl. ..... 399/43; 399/44; 399/94; 399/97; 399/261

(58) Field of Classification Search ..... 399/43, 399/44, 94, 97, 261
See application file for complete search history.

(56) References Cited

U.S. PATENT DOCUMENTS 3,754,531 A * 8/1973 Donalies ..... 399/293
4,212,264 A * 7/1980 Knechtel et al. ..... 399/261
5,270,785 A * 12/1993 Kita et al. ..... 399/261
5,729,803 A * 3/1998 Nakaue et al. ..... 399/261
5,742,885 A * 4/1998 Wayman ..... 399/293
5,852,757 A * 12/1998 Tooda et al. ..... 399/119
6,215,974 B1 * 4/2001 Katoh et al. ..... 399/258
7,187,876 B2 * 3/2007 Ito et al. ..... 399/27
7,283,772 B2 * 10/2007 Amano et al. ..... 399/258
7,697,858 B2 * 4/2010 Moon et al. ..... 399/53
2003/0228164 A1 * 12/2003 Katoh ..... 399/30
2004/0096251 A1 * 5/2004 Ahn et al. ..... 399/360
2004/0228649 A1 * 11/2004 Ban et al. ..... 399/106
2004/0264984 A1 * 12/2004 Yabuki et al. ..... 399/27
2005/0249533 A1 * 11/2005 Suda et al. ..... 399/358
2006/0051110 A1 * 3/2006 Koyama ..... 399/27

FOREIGN PATENT DOCUMENTS

JP 60024563 A * 2/1985
JP 10-186849 7/1998
JP 11-174808 7/1999
JP 2002-214894 7/2002
JP 2004-325725 11/2004
JP 2005-172842 6/2005

* cited by examiner

*Primary Examiner*—David M Gray
*Assistant Examiner*—Francis Gray
(74) *Attorney, Agent, or Firm*—Rabin & Berdo PC

(57) ABSTRACT

An image forming apparatus includes an image forming unit having an image carrier, a developing agent container for holding a developing agent, and a developing agent supplier for supplying the developing agent from the developing agent container to the image carrier. A controller determines the amount of use of the image forming unit. A shaking mechanism shakes the image forming unit from time to time, at intervals determined by the controller according to the amount of use of the image forming unit. The shaking loosens the developing agent so as to maintain its fluidity, thereby avoiding faint image formation.

20 Claims, 10 Drawing Sheets

IMAGE FORMING APPARATUS

BACKGROUND OF THE INVENTION

1. Field of the Invention

The present invention relates to an image forming apparatus that employs a developing agent.

2. Description of the Related Art

Developing agents are employed in electrophotographic image forming apparatus including printers, copiers, and facsimile machines. A typical apparatus of this type has a photosensitive drum that functions as an image carrier, a developer roller that applies a developing agent known as toner to develop an electrostatic latent image formed on the photosensitive drum, a toner supply roller with a porous surface that supplies toner to the developer roller, and an agitator or the like, disposed upwardly adjacent the toner supply roller, that stirs the toner to maintain a continuous flow of toner to the toner supply roller. A color image forming apparatus may have a plurality of these image forming units with toners of different colors.

Japanese Patent Application Publication No. 2005-172842 describes a type of agitator that revolves in a circular orbit, making periodic contact with the toner supply roller, to prevent a loss of fluidity of the toner in the vicinity of the toner supply roller due to the 'nip' between the developer roller and toner supply roller. At high printing speeds, however, even this type of agitator may fail to maintain a steady toner flow. The problem is that the rapidly revolving agitator flings toner away from it, so that after a while the agitator is revolving in a hollow space surrounded by compacted layers of toner banked against the walls of the toner container. As a result, the toner supply roller fails to receive an adequate supply of toner and printing becomes faint.

SUMMARY OF THE INVENTION

An object of the present invention is to provide an image forming apparatus with improved printing quality by preventing faint printing due to compaction of a developing agent.

The image forming apparatus provided by the present invention includes an image forming unit having an image carrier, a developing agent container for holding a developing agent such as toner, and a developing agent supplier for supplying the developing agent from the developing agent container to the image carrier. A controller monitors the amount of use of the image forming unit. A shaking mechanism shakes the image forming unit from time to time, at intervals determined by the controller according to the amount of use of the image forming unit.

The shaking loosens the developing agent so as to maintain its fluidity, even if the developing agent is stirred by a rapidly rotating agitator. As a result, faint printing is avoided and image quality is improved.

DETAILED DESCRIPTION OF THE INVENTION

Figure 1:
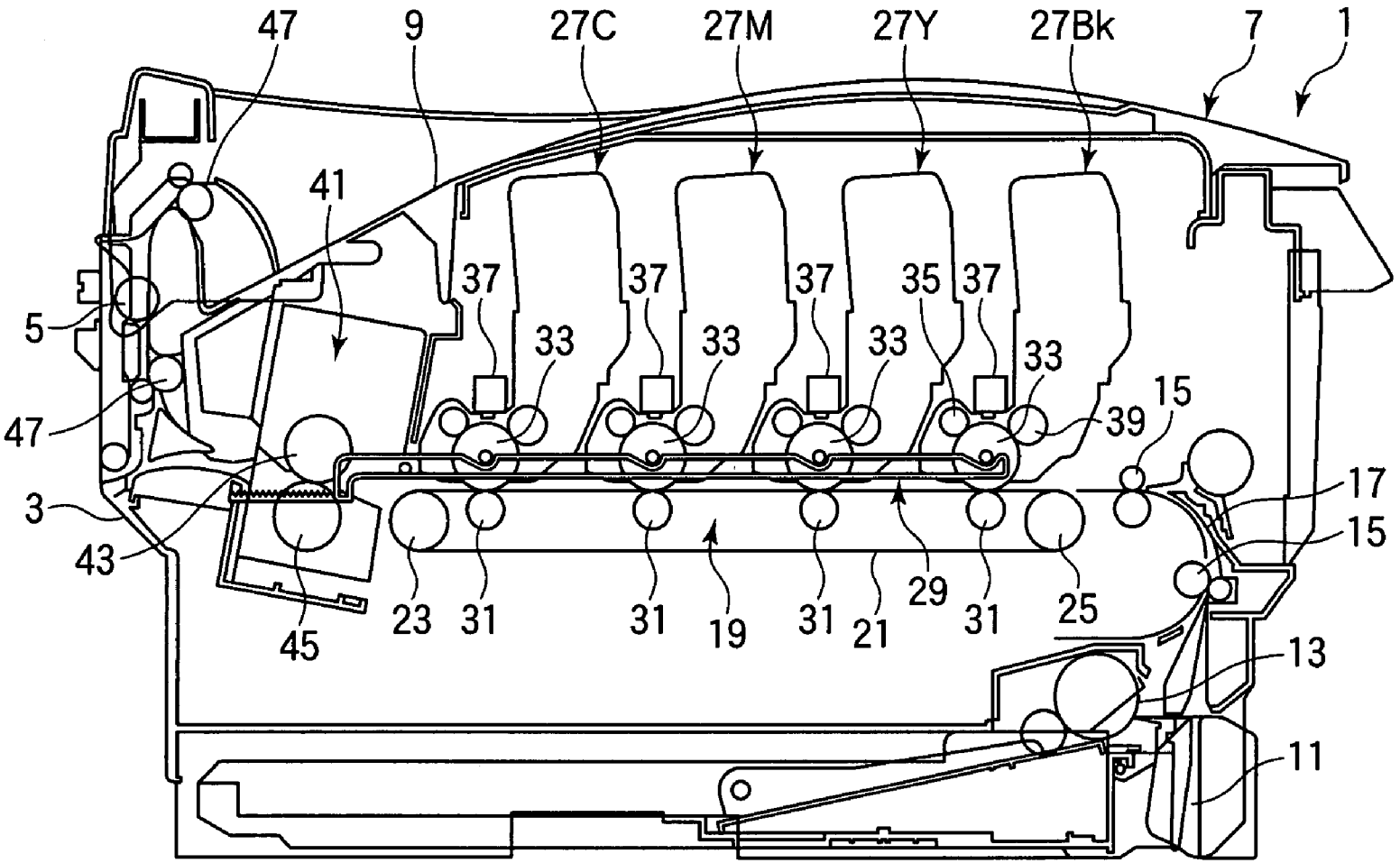
FIG. 1 is a side sectional view of a color electrophotographic printer embodying the present invention.

Printers embodying the present invention will now be described with reference to the attached drawings, in which like elements are indicated by like reference characters.

First Embodiment

Referring to FIG. 1, the printer 1 discussed in the embodiments has a housing comprising a lower cover 3, a clamshell shaft 5, an upper cover 7, and a stacker 9. The upper cover 7 is pivotably attached to the clamshell shaft 5 so that the upper cover 7 can be opened and closed. The stacker 9 is a part of the upper cover 7 that receives printed pages that have been ejected from the printer 1.

A cassette 11 located at the bottom of the lower cover 3 holds a supply of paper, which is picked up one sheet at a time by a hopping roller 13 and fed by a pair of feed rollers 15 across a media transport path 17 into a belt unit 19 comprising a media transport belt 21 that loops around a driving roller 23 and a following roller 25. The belt unit 19 carries the paper past a black image forming unit 27Bk, a yellow image forming unit 27Y, a magenta image forming unit 27M, and a cyan image forming unit 27C, which rest on a shaking mechanism 29, and past four transfer rollers 31. Each image forming unit includes a photosensitive drum 33 that functions as an image carrier, a charging roller 35 that electrically charges the surface of the photosensitive drum 33, a light emitting diode (LED) head 37 that selectively illuminates the photosensitive drum 33 to form a latent electrostatic image thereon, and a developer roller 39 that develops the latent electrostatic image by applying toner of the appropriate color. The transfer roller 31 below each photosensitive drum 33 attracts the toner from the surface of the photosensitive drum 33 onto the paper. As the paper travels past the four image forming units 27Bk, 27Y, 27M, 27C, a full-color image is built up. Toner that fails to be transferred from the photosensitive drum 33 to the paper is recovered from the photosensitive drum 33 by a cleaning blade (shown later).

The paper next enters a fuser 41 comprising a heat roller 43 and a pressure roller 45, which fuse the toner image onto the paper by a combination of heat and pressure. A pair of delivery rollers 47 then eject the paper onto the stacker 9. The photosensitive drum 33, the delivery rollers 47, and the other rollers mentioned above are driven by motors (not shown).

Figure 2:
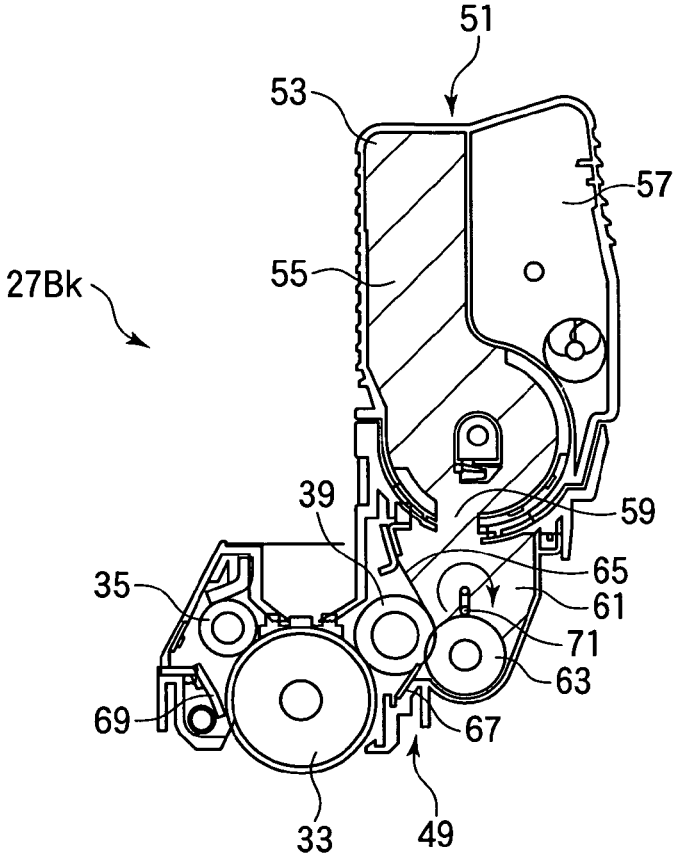
FIG. 2 is a sectional view of an image forming unit in the color electrophotographic printer in FIG. 1.

FIG. 2 shows the black image forming unit 27Bk in more detail. The other image forming units 27Y, 27M, 27C have similar structures.

As shown in FIG. 2, each image forming unit comprises a main image forming unit 49 and a detachable developing agent container or toner cartridge 51. The toner cartridge 51 includes a toner reservoir 53 that stores a supply of unused toner (developing agent) 55, and a toner recovery chamber 57. At the bottom of the toner reservoir 53 is an outlet 59 through which the toner 55 drops into a toner supply chamber 61 in the main image forming unit 49. The toner supply chamber 61 includes the developer roller 39, a toner supply roller 63 with a foam plastic or foam rubber surface that supplies toner 55 to the developer roller 39, a doctor blade 65 located just above the developer roller 39, and a film 67 that prevents unwanted toner 55 from entering the space between the developer roller 39 and photosensitive drum 33. The cleaning blade 69 is located on the far side of the photosensitive drum 33 from the developer roller 39. As the developer roller 39 turns counter-clockwise in the drawing, toner 55 is transferred to the developer roller 39 from the toner supply roller 63 in an amount regulated by the doctor blade 65, forming a thin layer of toner on the surface of the developer roller 39. The toner 55 is transferred electrostatically from the developer roller 39 to exposed parts of the photosensitive drum 33 to develop the latent electrostatic image.

Located just above the toner supply roller 63 is an agitator 71 that turns clockwise, periodically making contact with the surface of the toner supply roller 63. If the printer operates at a high speed, the agitator 71 turns at a correspondingly high speed, which can lead to the problem described in the background discussion: the agitator 71 carves out a hollow space, outside which the toner 55 becomes compacted against the walls of the toner supply chamber 61; inadequate toner reaches the surface of the toner supply roller 63; the supply of toner 55 to the developer roller 39 also becomes inadequate; and printing becomes faint.

To prevent this problem, the present invention provides the shaking mechanism 29 shown partly in FIG. 1, and more completely in FIGS. 3 to 6, to shake the image forming units 27Bk, 27Y, 27M, 27C.

Figure 3:
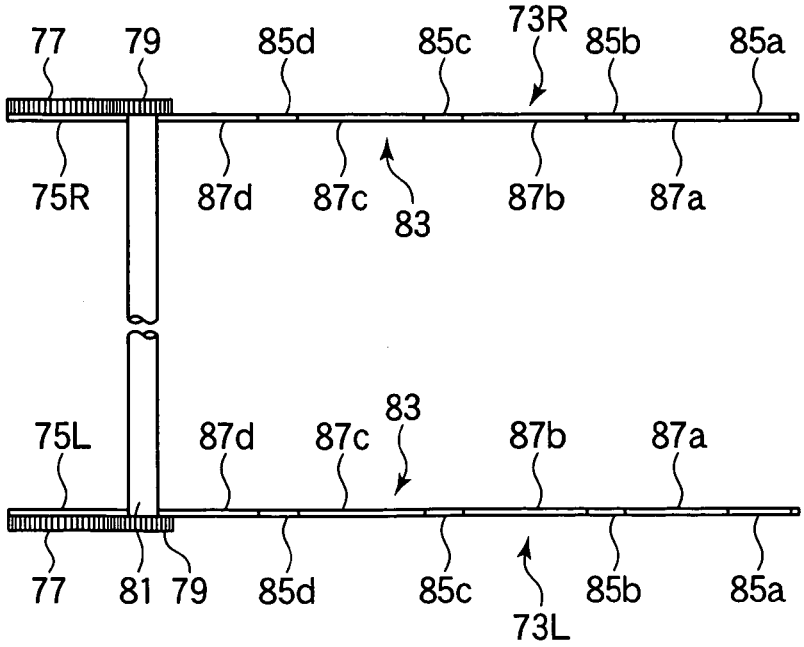
FIG. 3 is a plan view of the shaking mechanism in FIG. 1.

As seen in the top plan view in FIG. 3, the shaking mechanism 29 includes a pair of horizontal members 73L, 73R disposed on opposite sides of the printer, terminating in respective racks 75L, 75R that mesh with respective pinion gears 77. The pinion gears 77 are driven by a pair of transfer gears 79, which are connected by a connecting shaft 81 so that they turn in unison. The top edge of the main part 83 of each of the horizontal members 73L, 73R includes four grooves 85*a*, 85*b*, 85*c*, 85*d* interspersed with flat sections 87*a*, 87*b*, 87*c*, 87*d*, as best seen in the side views in FIGS. 4 and 5.

Figure 4:
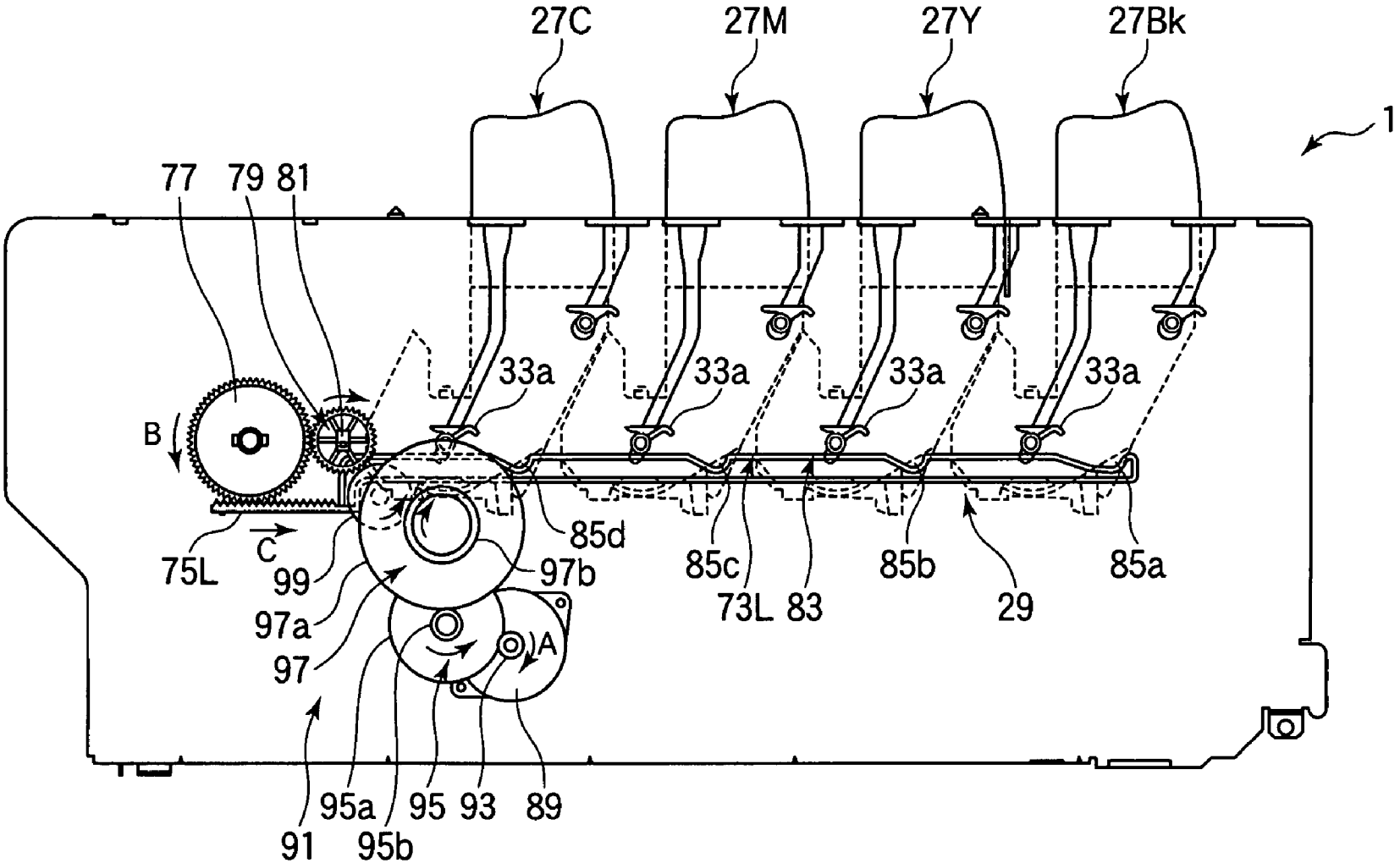
FIGS. 4 and 5 are more detailed side sectional views of the shaking mechanism in FIG. 1.
Figure 5:
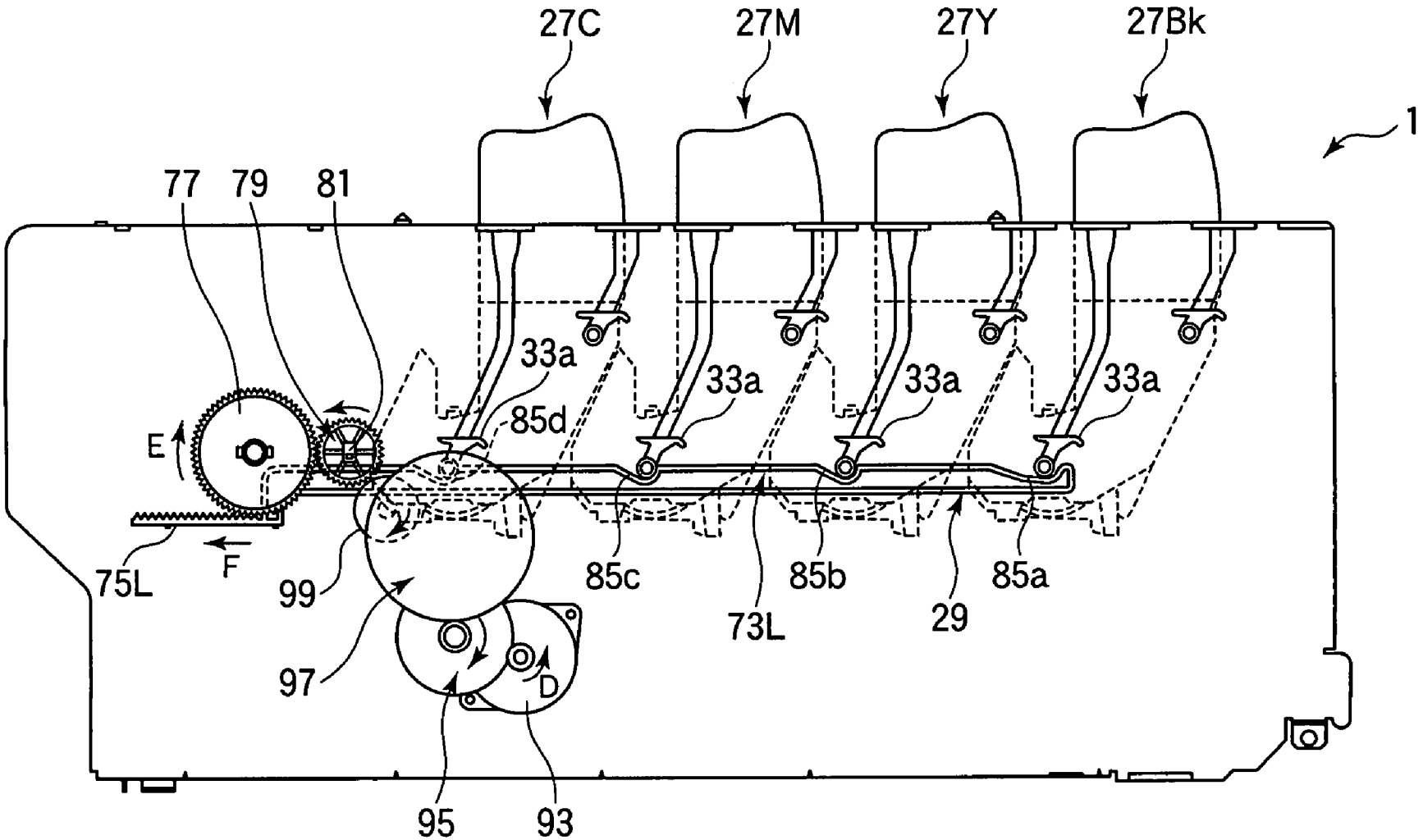

As shown in FIGS. 4 and 5, the transfer gears 79 are driven by a lifting motor 89 through a reducing gear train 91, thereby moving the horizontal members 73L, 73R back and forth parallel to the direction in which paper is transported past the image forming units 27Bk, 27Y, 27M, 27C. The reducing gear train 91 includes a small gear 93 mounted on the shaft of the lifting motor 89, a first double gear 95 comprising a large gear 95*a* and a small gear 95*b* that turn in unison, a second double gear 97 comprising a large gear 97*a* and a small gear 97*b* that turn in unison, and a further transfer gear 99. Small gear 93 meshes with large gear 95*a*, small gear 95*b* meshes with large gear 97*a*, and small gear 97*b* meshes with transfer gear 99, which meshes with one of the two transfer gears 79 that drive the pinion gears 77. Since these two transfer gears 79 are linked by the connecting shaft 81 and turn in unison, the two horizontal members 73L, 73R move back and forth together.

When the lifting motor 89 is driven in its forward direction, small gear 93 turns in the direction of arrow A in FIG. 4, causing the pinion gears 77 to turn in the direction of arrow B, so that the horizontal members 73L, 73R move backward, in the direction of arrow C, opposite to the direction of paper transport. When the lifting motor 89 is driven in its reverse direction, small gear 93 turns in the direction of arrow D in FIG. 5, causing the pinion gears 77 to turn in the direction of arrow E, so that the horizontal members 73L, 73R move forward, in the direction of arrow F, the direction of paper transport.

As shown in FIG. 5, when the horizontal members 73L, 73R are driven fully forward, the ends of the drum shafts 33*a* of the photosensitive drums of the image forming units 55Bk, 27Y, 27M, 27C rest at the bottoms of the grooves 85*a*, 85*b*, 85*c*, 85*d*.

As shown in FIG. 4, when the horizontal members 73L, 73R are driven fully backward, the ends of the drum shafts 33*a* climb onto the flat sections 87*a*, 87*b*, 87*c*, 87*d* of the horizontal members 73L, 73R, thereby lifting the image forming units 55Bk, 27Y, 27M, 27C upward.

Figure 6:
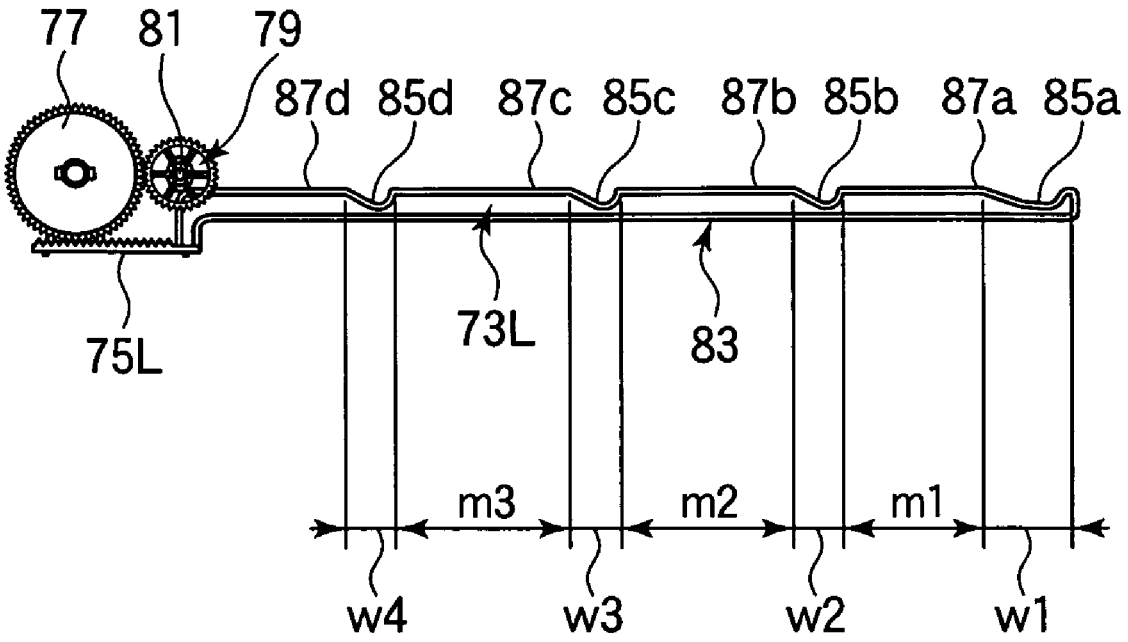
FIG. 6 is a side sectional view illustrating dimensions in the shaking mechanism.

Referring to FIG. 6, the lengths w1-w4 of the grooves 85*a*-85*d* and the lengths m1-m3 of the flat sections 87*a*-87*c* satisfy the following conditions:

$$w1>w2=w3=w4$$

$$m1<m2=m3$$

The grooves 85*a*-85*d* have sharply slanted back ends, which are disposed at mutual spacings equal to the spacing between the drum shafts 33*a* of the image forming units 55Bk, 27Y, 27M, 27C. The front ends of the grooves 85*a*-85*d* slant upward more gradually, and the first groove 85*a* is elongated by a flat level floor between its slanted ends. When the horizontal members 73L, 73R are driven backward from the position in FIG. 5 to the position in FIG. 4, first the yellow, magenta, and cyan image forming units 27Y, 27M, 27C are lifted up; then the black image forming unit 27Bk is lifted up. When the horizontal members 73L, 73R are driven forward from the position in FIG. 4 to the position in FIG. 5, the black image forming unit 27Bk is the first to drop back to its rest position on the floor of groove 85*a*, followed by the yellow, magenta, and cyan image forming units 27Y, 27M, 27C.

The horizontal members 73L, 73R accordingly have an intermediate position (not illustrated) at which the ends of the drum shaft 33*a* of the black image forming unit 27Bk rests on the floor of groove 85*a* and the ends of the drum shafts 33*a* of the yellow image forming unit 27Y, magenta image forming unit 27M, and cyan image forming unit 27C rest on flat sections 87*a*, 87*i*, and 87*j*. This intermediate position can be advantageously used in a black-and-white printing mode in which only the black image forming unit 27Bk is driven and the color image forming units 27Y, 27M, 27C are left idle to conserve power and avoid needless toner agitation.

Figure 7:
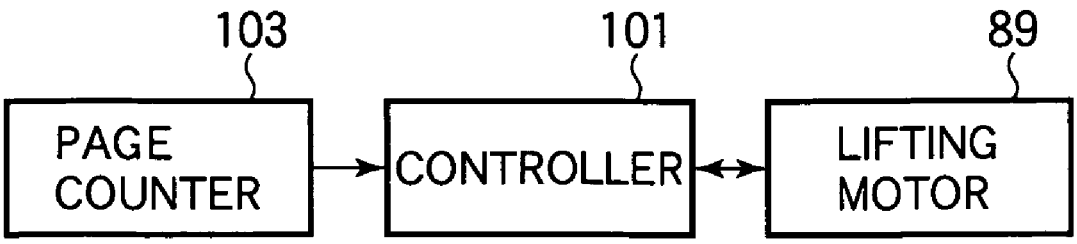
FIG. 7 is a block diagram illustrating the shaking control system in a first embodiment of the invention.

Referring to FIG. 7, the lifting motor 89 is controlled by a controller 101 on the basis of a page count output from a page counter 103. The page counter 103 counts the number of pages printed by the printer 1, as a measure of the amount of use of the image forming units 27Bk, 27Y, 27M, 27C. The controller 101 includes a computing device (not shown) equipped with a central processing unit, memory, and other well-known facilities. The controller 101 is programmed to activate the lifting motor 89 as explained below.

The controller 101 is also programmed to process image data received from a host device (not shown) and execute printing operations by controlling the image forming units 27Bk, 27Y, 27M, 27C, the fuser 41, and the motors (not shown) that drive the various rollers in the printer 1. Each time one page is printed, the controller 101 sends the page counter 103 a signal that increments the page count.

Image data are received in units referred to as jobs, each job including an arbitrary number of continuously printed pages. The controller 101 is programmed to recognize the end of a job by well-known methods. At the end of a job, the controller 101 checks the page count in the page counter 103. If the page count is equal to or greater than a predetermined shaking threshold such as, for example, one hundred pages, the controller 101 drives the lifting motor 89 backward and forward at least once, thereby shaking the image forming units 27Bk, 27Y, 27M, 27C by raising and lowering them at least once. The controller 101 concludes by driving the lifting motor 89 forward to leave the image forming units 27Bk, 27Y, 27M, 27C in the rest position shown in FIG. 5, and clears the page counter 103 to zero.

Figure 8:
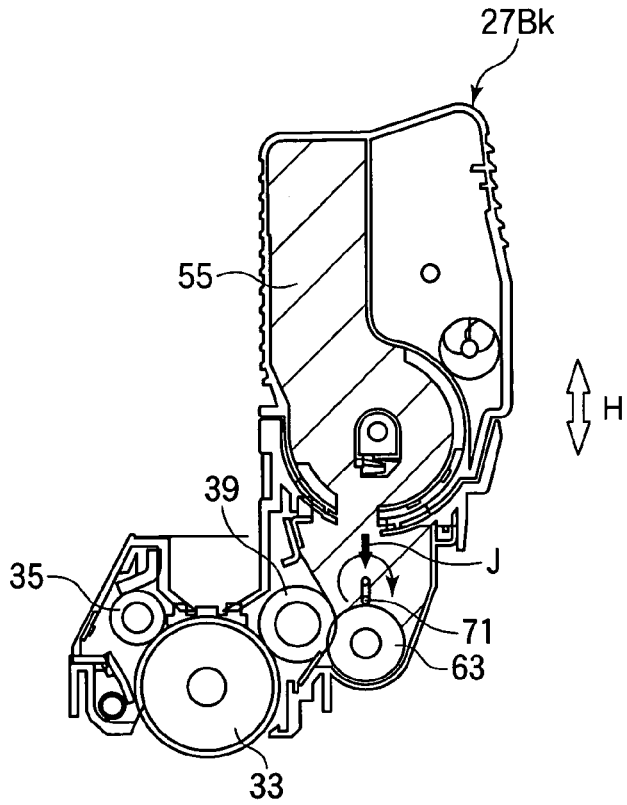
FIG. 8 is a sectional view of the image forming unit shown in FIG. 1, illustrating the direction of shaking and its effect on the toner.

The effect of raising and lowering the image forming units 27Bk, 27Y, 27M, 27C is shown schematically in FIG. 8. The vertical shaking motion is indicated by arrow H. If the toner 55 in the vicinity of the agitator 71 has been compacted by rapid rotation of the agitator 71, the vertical shaking motion H loosens the compacted toner. If the agitator 71 has hollowed out a space in its radius of motion, the vertical shaking motion H causes the loosened toner to fall into this space as indicated by arrow J, so that the toner supply roller 63 can pick up an adequate amount of toner 55 to deliver to the developer roller 39.

The optimum threshold value depends on the average density of printing on the pages. The higher the density of printing, the more pages can be printed without the problem of toner compaction.

Table 1 indicates the results of experiments performed at printing densities from 0.3% to 50%, with the shaking threshold set at values from fifty to three hundred pages. OK indicates that the problems of toner compaction and hollowing out were prevented, X indicates that these problems sometimes occurred, and P indicates that these problems occurred infrequently but were not completely prevented.

TABLE 1

| | Density | | | | | |
|---|---|---|---|---|---|---|
| Threshold | 0.3% | 3% | 5% | 10% | 25% | 50% |
| 50 pages | OK | OK | OK | OK | OK | OK |
| 100 pages | OK | OK | OK | OK | OK | OK |
| 150 pages | X | X | P | OK | OK | OK |
| 200 pages | X | X | X | P | OK | OK |
| 300 pages | X | X | X | X | P | OK |

A shaking threshold of one hundred pages prevented toner compaction and hollowing out at all printing densities. In the present embodiment, which uses a fixed page count as a shaking threshold, a threshold of about one hundred pages is appropriate.

Figure 9:
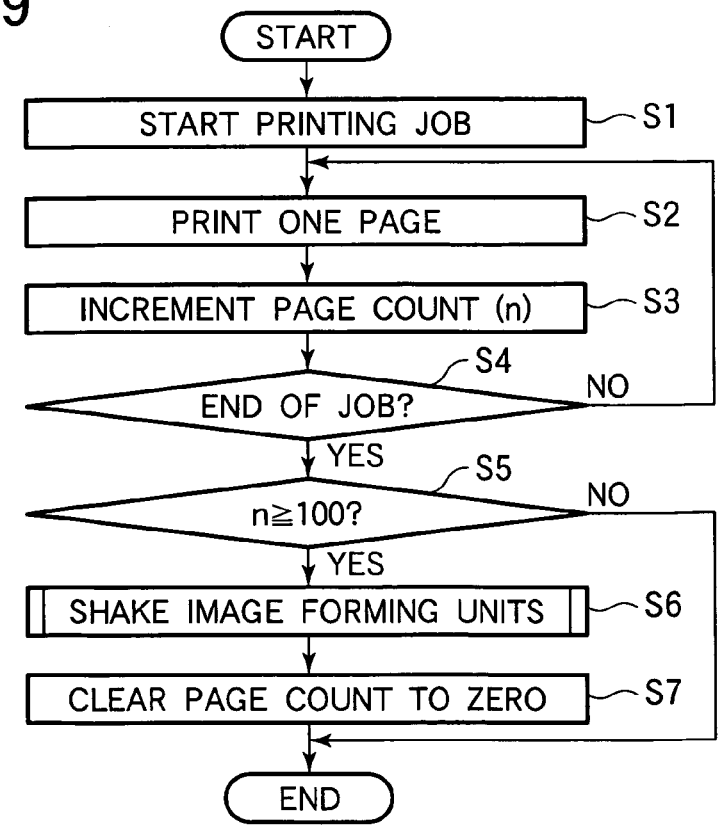
FIG. 9 is a flowchart illustrating the shaking control scheme according to the first embodiment.

FIG. 9 summarizes the operation of the first embodiment with a threshold of one hundred pages. In step S1, the printer starts a printing job. In step S2, one page is printed. In step S3, the page count (n) in the page counter 103 is incremented. In step S4, the controller 101 decides whether the printing job has ended, and returns to step S2 if the job has not ended.

When the job has ended, the controller 101 proceeds to step S5 and check the page count (n). If the page count is greater than or equal to one hundred pages (n≧100), then in step S6 the controller 101 drives the lifting motor 89 to shake the image forming units as described above, in step S7 the controller 101 clears the page counter 103 to zero, and the procedure then ends. If the page count is less than one hundred pages (n<100), the procedure ends immediately after step S5.

By shaking the image forming units from time to time, the controller 101 is able to prevent the problems of toner compaction and hollowing out and the consequent faint printing that occurred in the prior art.

Another problem prevented in the first embodiment is the display of an incorrect message on the printer's message display panel, indicating that the printer is running out of toner, when in fact the toner only needs to be shaken up.

Second Embodiment

The second embodiment has the same hardware configuration as the first embodiment. The lifting motor 89 is controlled by a controller 101 and a page counter 103 as shown in FIG. 7, but in the second embodiment the controller 101 is programmed to shake the image forming units after every hundred printed pages, regardless of whether the current printing job is finished or not.

Figure 10:
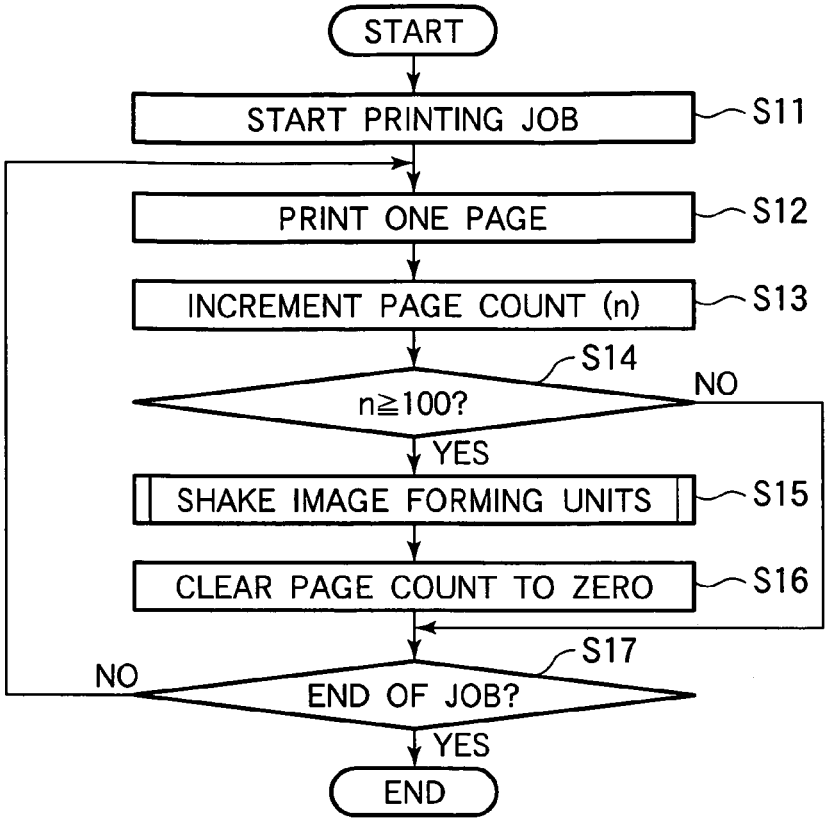
FIG. 10 is a flowchart illustrating the shaking control scheme according to a second embodiment of the invention.

The printer in the second embodiment operates according to the flowchart in FIG. 10. In step S11, the printer starts a printing job. In step S12, one page is printed. In step S13, the page count (n) in the page counter 103 is incremented.

In step S14, the controller 101 checks the page count (n) in the page counter 103. If the page count is greater than or equal to one hundred pages (n≧100), then in step S15 the controller 101 drives the lifting motor 89 backward and forward to shake the image forming units as described in the first embodiment, and in step S16 the controller 101 clears the page counter 103 to zero. If the page count is less than one hundred pages (n<100), then steps S15 and S16 are skipped.

In step S17, the controller 101 decides whether the printing job has ended, and returns to step S12 if the job has not ended. If the job has ended, the procedure in FIG. 10 ends.

By shaking the image forming units every hundred pages, the second embodiment prevents faint printing even during long printing jobs, lasting more than one hundred pages.

Third Embodiment

Figure 11:
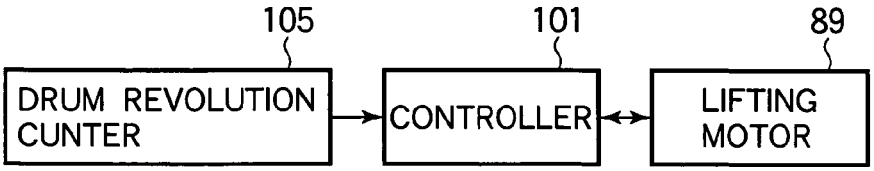
FIG. 11 is a block diagram illustrating the shaking control system in a third embodiment.

The third embodiment replaces the page counter of the first and second embodiments with a drum revolution counter 105, shown in FIG. 11, that counts revolutions of the photosensitive drums 33 of the image forming units 27Bk, 27Y, 27M, 27C.

In the third embodiment, the controller 101 checks the revolution count in the drum revolution counter 105 at the end of each printed page, and drives the lifting motor 89 to shake the image forming units 27Bk, 27Y, 27M, 27C if the revolution count has reached a predetermined shaking threshold. After driving the lifting motor 89, the controller 101 clears the drum revolution counter 105 to zero before printing the next page.

The third embodiment is particularly advantageous when the rotation of the agitator 71 in each image forming unit is linked to the rotation of the photosensitive drum 33, and when the photosensitive drums 33 make different numbers of revolutions per page depending on, for example, the page length.

In a variation of the third embodiment, the controller 101 checks the drum revolution counter 105 only at the end of each printing job, as in the first embodiment, instead of at the end of each page.

Fourth Embodiment

Figure 12:
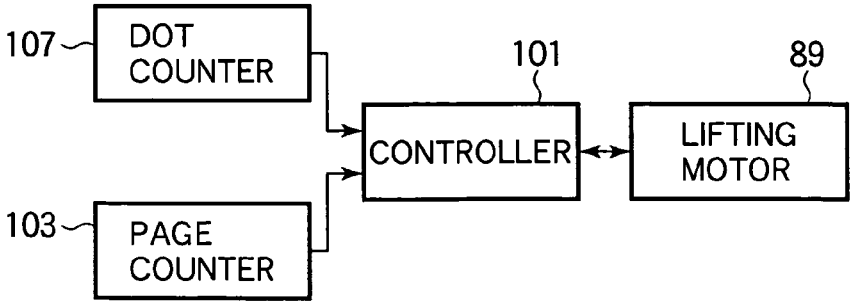
FIG. 12 is a block diagram illustrating the shaking control scheme according to a fourth embodiment.

The fourth embodiment adds a dot counter 107, shown in FIG. 12, to the page counter 103 of the first and second embodiments. The controller 101 controls the lifting motor 89 according to both the number of pages printed and the number of dots printed on the pages, and shortens the intervals at which the image forming units are shaken when the printing density is low. The intervals between shakings are thus varied according to the rate of consumption of the toner.

Figure 13:
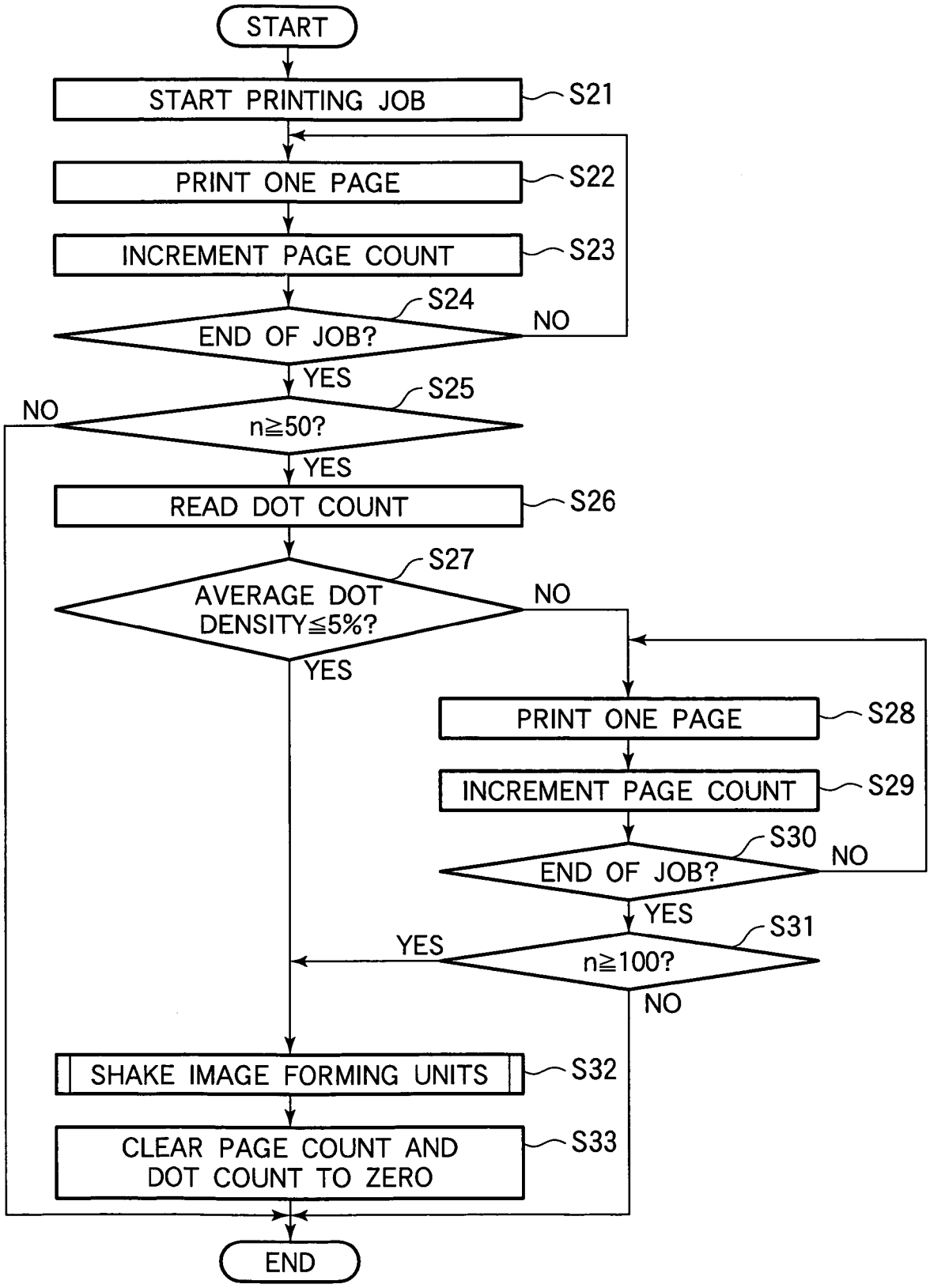
FIG. 13 is a flowchart illustrating the shaking control scheme according to the fourth embodiment.

The operation of the fourth embodiment will be described with reference to the flowchart in FIG. 13.

In step S21, the printer starts a printing job. In step S22, one page is printed. During this step, the dot counter 107 is incremented by one for each printed dot. The dot counter 107 may be incremented when, for example, the dot data are read into the LED heads 37.

In step S23, the page count (n) in the page counter 103 is incremented. In step S24, the controller 101 decides whether the printing job has ended, and returns to step S22 if the job has not ended.

When the job has ended, the controller 101 proceeds to step S25 and checks the page count (n). If the page count is less than fifty pages (n<50), the procedure ends.

If the page count is greater than or equal to fifty pages (n≧50), then in steps S26 and S27 the controller 101 reads the printed dot count from the dot counter 107, divides the printed dot count by the page count do determine the average number of dots printed per page, and compares this average number with a predetermined value to decide whether or not the printing density is greater than 5%.

If the printing density is greater than 5% in step S27, the controller 101 waits for the next printing job to start. When the next printing job starts, the controller 101 prints a page in step S28, increments the page counter 103 in step S29, decides whether the job has ended in step S30, and returns to step S28 if the job has not ended. When the job ends, the controller 101 proceeds to step S31 and decides whether the page count in the page counter 103 is greater than or equal to one hundred. If the page count is less than one hundred (n<100), the procedure ends.

If the page count is equal to or greater than one hundred (n≧100) in step S31, or if the average printing density is equal to or less than 5% in step S27, the controller 101 proceeds to step S32 and drives the lifting motor 89 to shake the image forming units as described in the first embodiment, then clears the page counter 103 and dot counter 107 to zero in step S33, after which the procedure ends.

In the fourth embodiment, when the printing density is less than 5%, the image forming units are shaken at intervals of fifty pages or so. When the printing density is 5% or higher, the image forming units are shaken at longer intervals of one hundred pages or so. In view of the data in Table 1 above, these intervals between shakings can be expected to provide adequate protection from toner compaction and faint printing.

In a variation of the fourth embodiment, the controller 101 checks the page count at the end of each printed page, instead of the end of each job, as in the second embodiment, to ensure that the intervals between shakings are exactly fifty pages for low-density printing and one hundred pages for higher-density printing.

In another variation of the fourth embodiment, the page counter 103 is replaced by a drum revolution counter as in the third embodiment.

Fifth Embodiment

Figure 14:
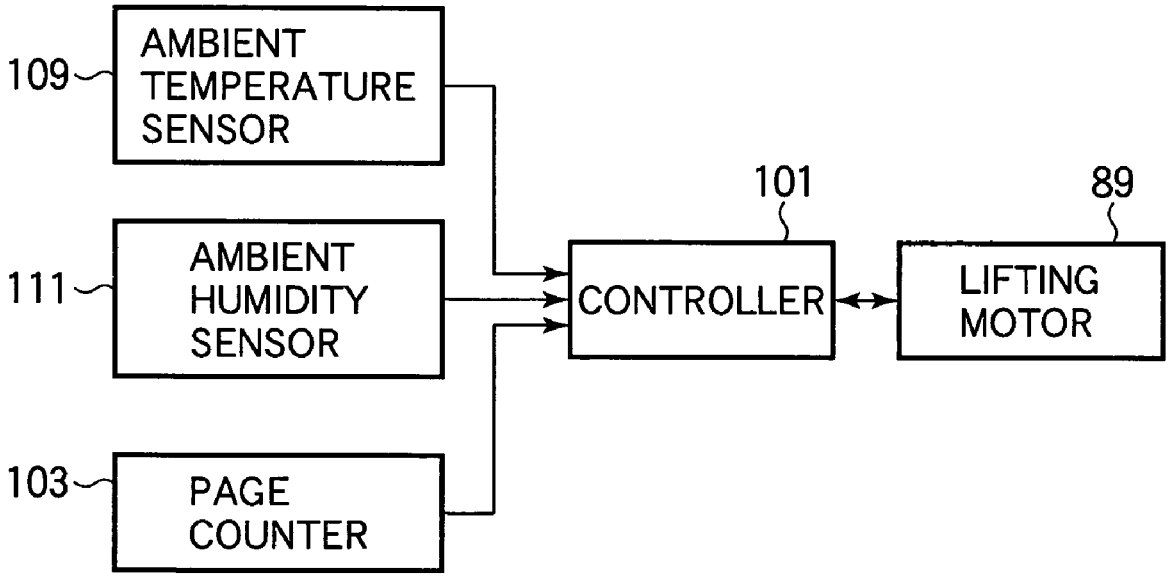
FIG. 14 is a block diagram illustrating the shaking control system in a fifth embodiment.

The fifth embodiment adds an ambient temperature sensor 109 and an ambient humidity sensor 111, shown in FIG. 14, to the page counter 103 of the first and second embodiments, and controls the intervals between shakings according to environmental conditions as well as the number of pages printed. The ambient temperature sensor 109 senses the ambient temperature τ and sends the controller 101 a signal indicating the temperature. The ambient humidity sensor ill senses the ambient humidity f and sends the controller 101 a signal indicating the humidity. The controller 101 controls the lifting motor 89 according to the ambient temperature, ambient humidity, and printed page count.

The problems of toner compaction, hollowing out, and faint printing are most likely to occur under conditions of high temperature and high humidity. Table 2 indicates the results of high-speed printing trials made under various temperature and humidity conditions. OK indicates that that the above problems did not occur, X indicates that these problems sometimes occurred, P indicates that these problems occurred infrequently but were not completely prevented, and dashes indicate combinations of conditions that were not tested. All problems observed occurred at temperatures of 20° C. or higher and in almost all cases at a humidity of 40% or higher. In the fourth embodiment, accordingly, the image forming units are shaken only when the temperature is above 20° C. and the humidity is above 40%. Under these conditions, the shaking interval is fifty pages.

TABLE 2

| | Humidity | | | |
|---|---|---|---|---|
| Temperature | 20% | 40% | 60% | 80% |
| 10° C. | OK | — | — | — |
| 15° C. | OK | — | — | — |
| 20° C. | — | P | X | — |
| 25° C. | — | P | X | — |
| 30° C. | P | — | — | X |

Figure 15:
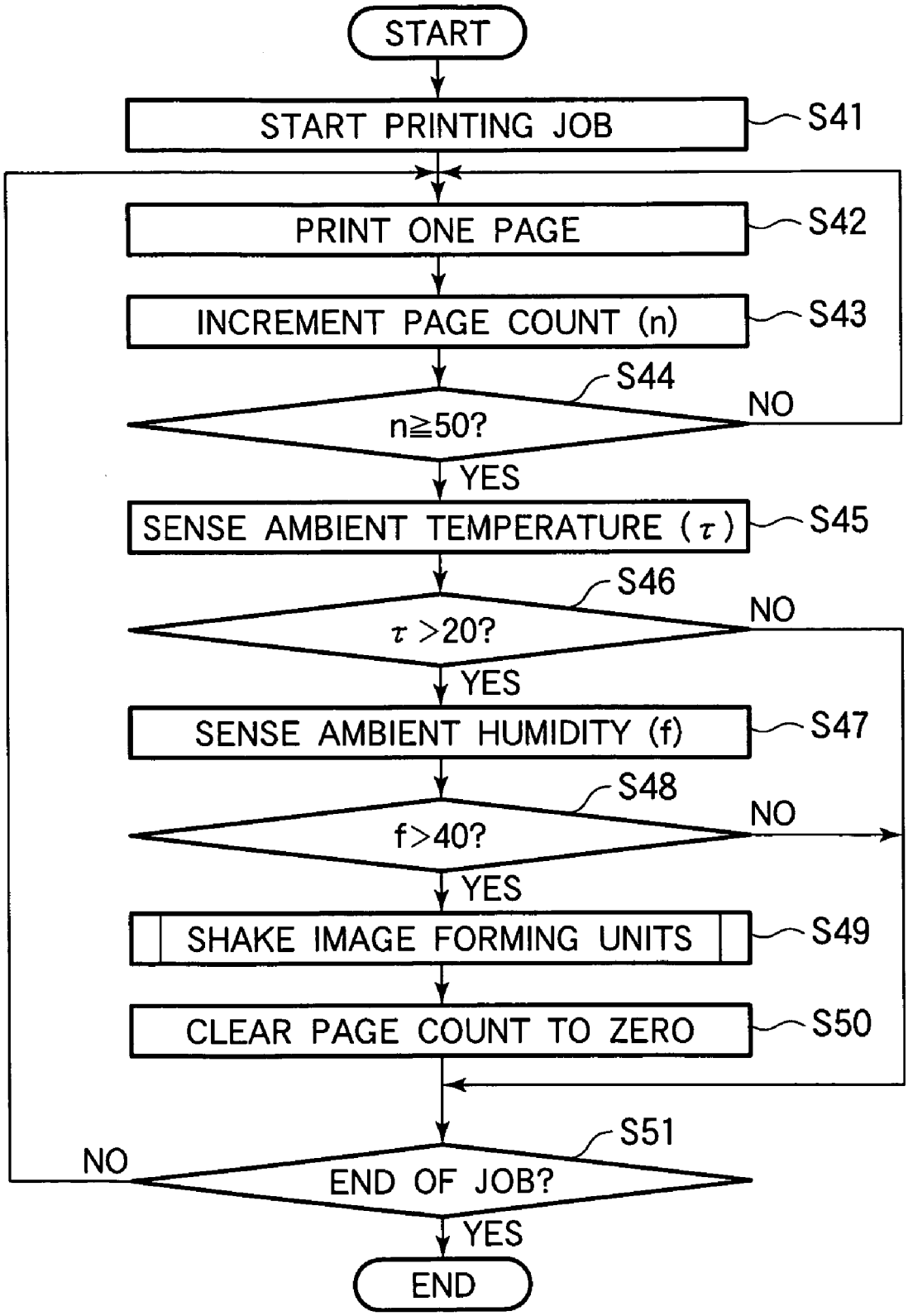
FIG. 15 is a block diagram illustrating the shaking control scheme according to a fifth embodiment.

The printer in the fifth embodiment operates according to the flowchart in FIG. 15. In step S41, the printer starts a printing job. In step S42, one page is printed. In step S43, the page count (n) in the page counter 103 is incremented.

In step S44, the controller 101 checks the page count (n) in the page counter 103 and returns to step S42 if the page count is less than fifty pages (n<50). If the page count is greater than or equal to fifty pages (n≧50), then in steps S45 and S46 the controller 101 senses the ambient temperature by checking the ambient temperature sensor 109 and decides whether the temperature τ is greater than 20° C. If the temperature τ is greater than 20° C., then in steps S47 and S48 the controller 101 checks the ambient humidity sensor 111 and decides whether the humidity f is greater than 40%. If the humidity f is greater than 40%, then in step S49 the controller 101 drives the lifting motor 89 backward and forward to shake the image forming units as described in the first embodiment, and in step S50 the controller 101 clears the page counter 103 to zero. Next, in step S51, the controller 101 decides whether the printing job has ended, and returns to step S42 if the job has not ended.

If the temperature is less than or equal to 20° C., the controller 101 skips steps S47 to S50 and proceeds directly from step S46 to step S51. If the humidity is less than or equal to 40%, the controller 101 skips steps S49 and S50 and proceeds directly from step S48 to step S51. In either of these two cases the image forming units are not shaken.

By shaking the image forming units at intervals of fifty pages, but only under conditions of comparatively high temperature and humidity, the second embodiment prevents toner compaction and hollowing out under conditions that produce these problem, and avoids needlessly shaking the image forming units under conditions in which toner compaction is unlikely to occur.

In a variation of the fifth embodiment, the page counter 103 is replaced by a drum revolution counter as in the third embodiment.

In another variation of the fifth embodiment, the image forming units are shaken at intervals that decrease with increasing temperature and humidity.

In yet another variation of the fifth embodiment, only a temperature sensor, or only a humidity sensor, is provided.

The invention is not limited to the fifty-page and hundred-page thresholds shown in the embodiments above. Other threshold values may be used. In the fifth embodiment, the threshold page count may be varied according to the ambient temperature and humidity, so that the intervals between shakings become shorter with increasing temperature and humidity.

The invention is not limited to image forming units of the type shown in FIGS. 1 and 2. For example, the image carrier may be a photosensitive belt instead of a photosensitive drum.

Those skilled in the art will recognize that further variations are possible within the scope of the invention, which is defined in the appended claims.

What is claimed is:

1. An image forming apparatus, comprising:

an image forming unit having an image carrier, a developing agent container for holding a developing agent, and a developing agent supplier for supplying the developing agent from the developing agent container to the image carrier;

a shaking mechanism for shaking the image forming unit; and controller means for determining an amount of use of the image forming unit and for controlling the shaking mechanism so as to shake the image forming unit when the amount of use of the imaging forming unit exceeds a predetermined threshold.

2. The image forming apparatus of claim 1, wherein the shaking mechanism raises and lowers the image forming unit.

3. The image forming apparatus of claim 2, wherein the shaking mechanism comprises a pair of horizontal members having flat upper surfaces with respective grooves, the grooves having slanted ends;

wherein the image forming unit comprises a shaft with ends that normally rest in the grooves of the horizontal members; and wherein the shaking mechanism shakes the image forming unit by moving the horizontal members back and forth so that the ends of the shaft ride up the slanted ends of the grooves onto the flat surfaces of the horizontal members, then return into the grooves.

4. The image forming apparatus of claim 3, wherein horizontal members comprise respective racks, and the shaking mechanism further comprises:

a pair of pinion gears engaging the racks; and a motor for driving the pair of pinion gears.

5. The image forming apparatus of claim 2, wherein the image forming apparatus comprises a plurality of image forming units each having a shaft, the plurality of image forming units including a black image forming unit and at least one color image forming unit;

wherein the shaking mechanism comprises a pair of horizontal members having flat upper surfaces with respective first grooves for receiving respective ends of the shaft of the black image forming unit and respective second grooves for receiving respective ends of the shaft of each color image forming unit, the first and second grooves having slanted ends, the first grooves being wider than the second grooves; and wherein the shaking mechanism shakes the plurality of image forming units by moving the horizontal members back and forth so that the ends of the shafts of the plurality of image forming units ride up the slanted ends of the first and second grooves onto the flat surfaces of the horizontal members, then return into the first and second grooves.

6. An image forming apparatus, comprising:

an image forming unit having an image carrier, a developing agent container for holding a developing agent, and a developing agent supplier for supplying the developing agent from the developing agent container to the image carrier;

a shaking mechanism for shaking the image forming unit; and a controller for determining an amount of use of the image forming unit and controlling the shaking mechanism so as to shake the image forming unit periodically, at intervals responsive to the amount of use of the image forming unit, wherein the controller determines the amount of use of the image forming unit by counting a number of pages on which images have been formed after the image forming unit has been shaken.

7. The image forming apparatus of claim 6, wherein the controller controls the shaking mechanism to shake the image forming unit when the number of pages counted reaches a predetermined value.

8. The image forming apparatus of claim 6, wherein the controller controls the shaking mechanism to shake the image forming unit upon conclusion of a printing job if the number of pages counted has reached at least a predetermined value.

9. An image forming apparatus, comprising:

an image forming unit having an image carrier, a developing agent container for holding developing agent, and a developing agent supplier for supplying the developing agent from the developing agent container to the image carrier;

a shaking mechanism for shaking the image forming unit; and a controller for determining an amount of use of the image forming unit and controlling the shaking mechanism so as to shake the image forming unit periodically, at intervals responsive to the amount of use of the image forming unit, wherein the image carrier is a photosensitive drum, and the controller determines the amount of use of the image forming unit by counting a number of revolutions of the photosensitive drum after the image forming unit has been shaken.

10. The image forming apparatus of claim 9, wherein the controller controls the shaking mechanism to shake the image forming unit when the number of revolutions counted reaches a predetermined value.

11. The image forming apparatus of claim 9, wherein the controller controls the shaking mechanism to shake the image forming unit upon conclusion of a printing job if the number of revolutions counted has reached at least a predetermined value.

12. An image forming apparatus, comprising an image forming unit having an image carrier, a developing agent container for holding a developing agent, and a developing agent supplier for supplying the developing agent from the developing agent container to the image carrier;

a shaking mechanism for shaking the image forming unit; and a controller for determining an amount of use of the image forming unit and controlling the shaking mechanism so as to shake the image forming unit periodically, at intervals responsive to the amount of use of the image forming unit, wherein the controller determines the amount of use of the image forming unit from an amount of the developing agent consumed after the image forming unit has been shaken.

13. The image forming apparatus of claim 12, wherein the controller determines a rate of consumption from the amount of developing agent consumed, and controls the shaking mechanism to shake the image forming unit at different intervals depending on the rate of consumption including selecting comparatively short intervals for comparatively low rates of consumption.

14. An image forming apparatus, comprising:

an image forming unit having an image carrier, a developing agent container for holding a developing agent, and a developing agent supplier for supplying the developing agent from the developing agent container to the image carrier;

a shaking mechanism for shaking the image forming unit; and a controller for determining an amount of use of the image forming unit and controlling the shaking mechanism so as to shake the image forming unit periodically, at intervals responsive to the amount of use of the image forming unit; and an environmental sensor for sensing an ambient environmental condition, wherein the controller determines the intervals between shakings of the image forming unit according to the ambient environmental condition as well as amount of use of the image forming unit.

15. The image forming apparatus of claim 14, wherein the environmental sensor is a temperature sensor for sensing ambient temperature.

16. The image forming apparatus of claim 15, wherein the controller controls the shaking mechanism to shake the image forming unit only when the ambient temperature sensed by the temperature sensor is above a predetermined temperature.

17. The image forming apparatus of claim 15, wherein the controller varies the intervals between shakings of the image forming unit according to the ambient temperature including selecting comparatively short intervals for comparatively high ambient temperatures.

18. The image forming apparatus of claim 14, wherein the environmental sensor is a humidity sensor for sensing ambient humidity.

19. The image forming apparatus of claim 18, wherein the controller controls the shaking mechanism to shake the image forming unit only when the ambient humidity sensed by the humidity sensor is above a predetermined humidity.

20. The image forming apparatus of claim 18, wherein the controller varies the intervals between shakings of the image forming unit according to the ambient humidity, selecting comparatively short intervals for comparatively high humidities.

* * * * *